United States Patent [19]

Mitter

[11] 3,998,157

[45] Dec. 21, 1976

[54] PIVOTAL SQUEEGEE MOUNT WITH FLUID BIAS

[75] Inventor: Mathias Mitter, Verl-Sende-Mitte, Germany

[73] Assignee: Mitter & Co., Schloss Holte, Germany

[22] Filed: June 19, 1974

[21] Appl. No.: 479,939

[30] Foreign Application Priority Data

June 20, 1973 Germany ..... 2331322

[52] U.S. Cl. ..... 101/120; 101/122

[51] Int. Cl.[2] ..... B41F 15/08; B41F 15/44

[58] Field of Search ..... 101/116, 119, 121, 122, 101/120

[56] References Cited

UNITED STATES PATENTS

| | | | |
|---|---|---|---|
| 1,956,562 | 5/1934 | Coates | 101/120 UX |
| 2,363,137 | 11/1944 | Metcalf | 101/120 |
| 2,928,340 | 3/1960 | Stein et al. | 101/120 |
| 3,029,779 | 4/1962 | Hornbostel | 101/120 UX |
| 3,110,919 | 11/1963 | Barnby | 101/120 UX |
| 3,718,086 | 2/1973 | Vertegaal | 101/115 |
| 3,735,730 | 5/1973 | Mitter | 101/120 X |
| 3,795,188 | 3/1974 | Giani | 101/120 X |
| 3,934,502 | 1/1976 | Marino | 101/115 |

FOREIGN PATENTS OR APPLICATIONS

| | | | |
|---|---|---|---|
| 2,006,887 | 1/1970 | France | 101/120 |

*Primary Examiner*—Clifford D. Crowder
*Assistant Examiner*—R. E. Suter
*Attorney, Agent, or Firm*—Michael J. Striker

[57] ABSTRACT

A screen printing machine wherein a cylindrical stencil is rotatable about a horizontal axis and the liquid-supplying header in the stencil supports a carrier for a horizontal pintle pivotably mounting an elongated holder for a blade-like or rod-like squeegee. A gas-filled deformable cushion between the carrier and the holder biases the squeegee against the internal surface of the stencil opposite the locus where the external surface of the stencil contacts the material to be printed. Several helical springs which are attached to the holder and to the header bias the holder upwardly with a force which compensates for the combined weight of the squeegee and holder so that the force with which the squeegee bears against the internal surface of the stencil depends exclusively on the regulatable pressure of gaseous fluid in the cushion.

19 Claims, 8 Drawing Figures

S
F
P
91
3
10
90
9
1
2
G
V
V
10
3
91
90
9
P
S
F 91b
94
92
93
90
91
91a
92a
3

92
90
97
94
92a
91a
3
91c
91b
93
VI
VI
96
91
95
97

III
III
3
5
6
R
L
K
41
75
8
4
42
72
71
7

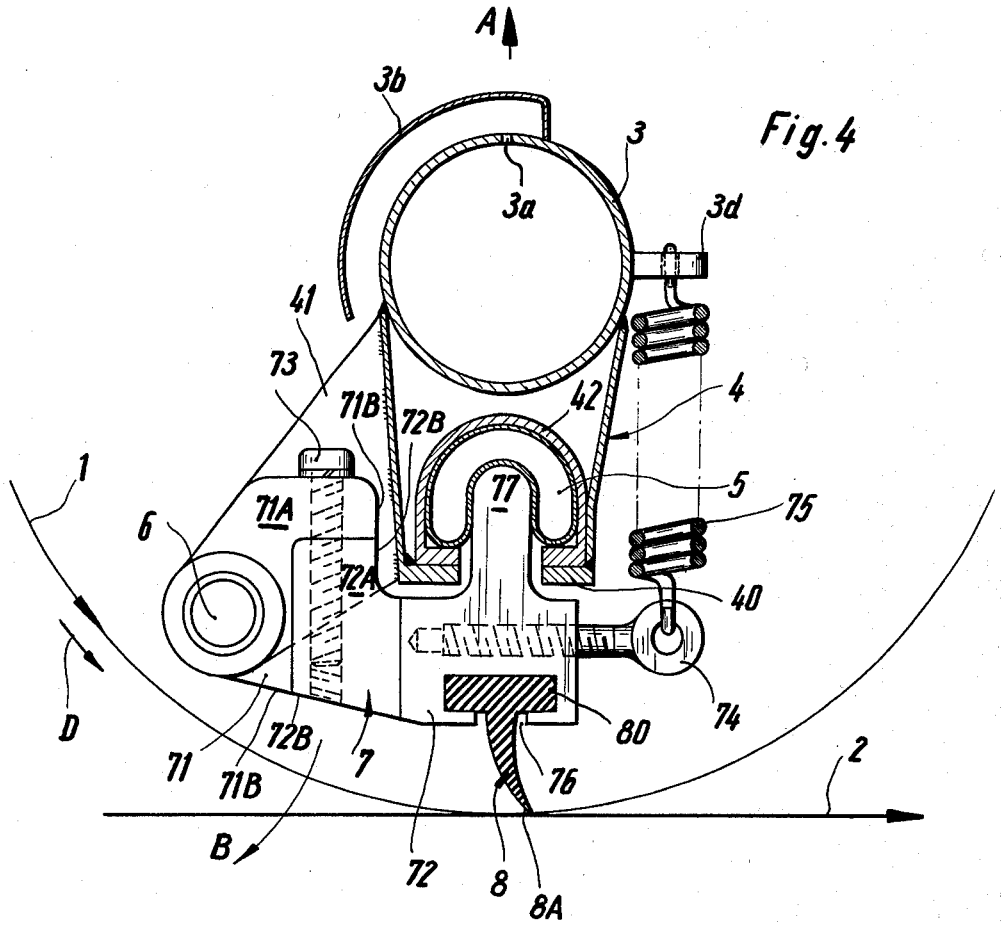
Fig. 4
Fig. 4a
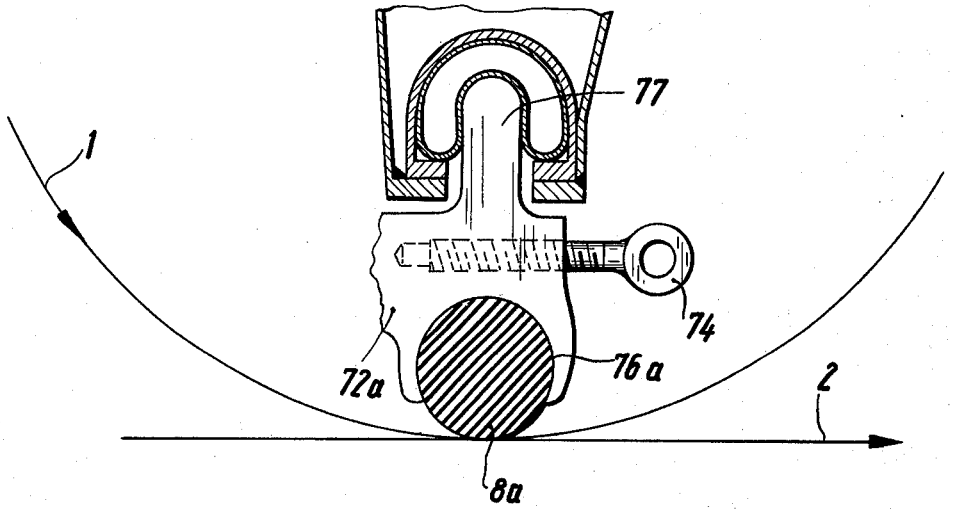

200
10
1a
1
91
S
3
92
93
90
2
209
202
208
204
201
6
9
203
205
207
206

PIVOTAL SQUEEGEE MOUNT WITH FLUID BIAS

BACKGROUND OF THE INVENTION

The present invention relates to screen printing machines in general, and more particularly to improvements in means for mounting a squeegee in the interior of the moving stencil or screen of a screen printing machine.

It is already known to utilize in a screen printing machine a squeegee which resembles an elongated doctor blade and is secured to a holder which, in turn, is movably mounted on a support. A gas-filled deformable cushion is interposed between the support and the holder to bias the squeegee against the internal surface of the stencil. Such screen printing machines exhibit the drawback that the entire weight of the squeegee, plus the weight of the holder, rests on the internal surface of the stencil, and that the pressure due to such combined weight is augmented by the bias of the cushion which urges the squeegee against the internal surface of the stencil. If the squeegee is a blade, the edge portion of the blade is urged against the stencil with a very large force which can be readily withstood only if the blade consists of a high-grade steel or the like. The material of the blade is stressed not only due to the aforementioned bias of the cushion augmented by the weight of the blade and its holder, but also by the moving stencil which tends to flex the edge portion of the blade sideways. Still further, the blade must be sufficiently resistant to avoid undesirable oscillation in response to shaking and/or other stresses. Consequently, the blade is normally a relatively thick, sturdy and heavy piece of steel. However, even such sturdy blades are incapable of invariably standing all stresses which arise in the operation of a screen printing machine, for example, in response to changes in the speed of the stencil. It has been found that changes in the speed of the stencil cause a shift in the locus where the edge portion of the blade engages the internal surface of the stencil, and this can affect the quality and reproducibility of the printing operation.

SUMMARY OF THE INVENTION

An object of the invention is to provide a novel and improved mounting for the squeegee in the interior of a cylindrical or band-like stencil of a screen printing machine.

Another object of the invention is to provide a screen printing machine which can employ elastically deformable blade-like squeegees and wherein the magnitude of the force with which the squeegee bears against the internal surface of the stencil can be regulated with a requisite degree of accuracy and reproducibility.

A further object of the invention is to provide a screen printing machine wherein the magnitude of forces acting against the squeegee in the stencil is a small fraction of the magnitude of forces acting on the squeegee in a conventional machine.

An additional object of the invention is to provide a screen printing machine which can utilize relatively thin and lightweight blade-like squeegees without the risk of excessive vibration and/or other stray movements of the squeegee when the machine is in use.

Still another object of the invention is to provide a novel and improved holder for a blade-like or cylindrical squeegee of metallic or rubber-like material, and to provide novel and improved support means and biasing means for the holder.

A further object of the invention is to provide a novel and improved squeegee and a novel and improved supporting and holding structure for the squeegee which can be installed in existing screen printing machines as a superior substitute for presently employed structures.

The invention is embodied in a screen printing machine which comprises an elongated tubular (cylindrical or band-like) liquid-permeable stencil having endless internal and external surfaces, means for moving the stencil relative to a moving web of a material to be printed so that successive increments of the external surface of the stencil contact successive increments of the web, stationary support means located in the interior of the stencil (such support means may include a liquid-supplying tube or header), a holder, a squeegee mounted in the holder adjacent to the internal surface of the stencil, means for pivotably coupling the holder to the support means so that the holder can turn about a preferably horizontal axis which is parallel to the longitudinal extension of the stencil (i.e., to the axis of a cylindrical stencil) and is located ahead of the squeegee, as considered in the direction of movement of the stencil, and means (preferably a gas-filled deformable cushion) for biasing the holder so as to urge the squeegee against the internal surface of the stencil. The cushion is preferably received in a substantially U-shaped portion of a carrier of the support means, and the holder is preferably provided with an extension which bears against the cushion and imparts to the latter a substantially kidney-shaped cross-sectional profile.

The machine preferably further comprises means for biasing the squeegee and the holder in a direction to move the squeegee away from the internal surface of the stencil with a force which compensates for the combined weight of the squeegee and holder so that the pressure with which the squeegee bears against the internal surface of the stencil can be regulated by changing the pressure of fluid which is entrapped in the cushion.

The novel features which are considered as characteristic of the invention are set forth in particular in the appended claims. The improved screen printing machine itself, however, both as to its construction and its mode of operation, together with additional features and advantages thereof, will be best understood upon persual of the following detailed description of certain specific embodiments with reference to the accompanying drawing.

BRIEF DESCRIPTION OF THE DRAWING

FIG. 4 is an enlarged view of a detail in FIG. 3;

FIG. 4*a* is a similar view of a detail in a modified screen printing machine;

DESCRIPTION OF THE PREFERRED EMBODIMENTS

Figure 1:
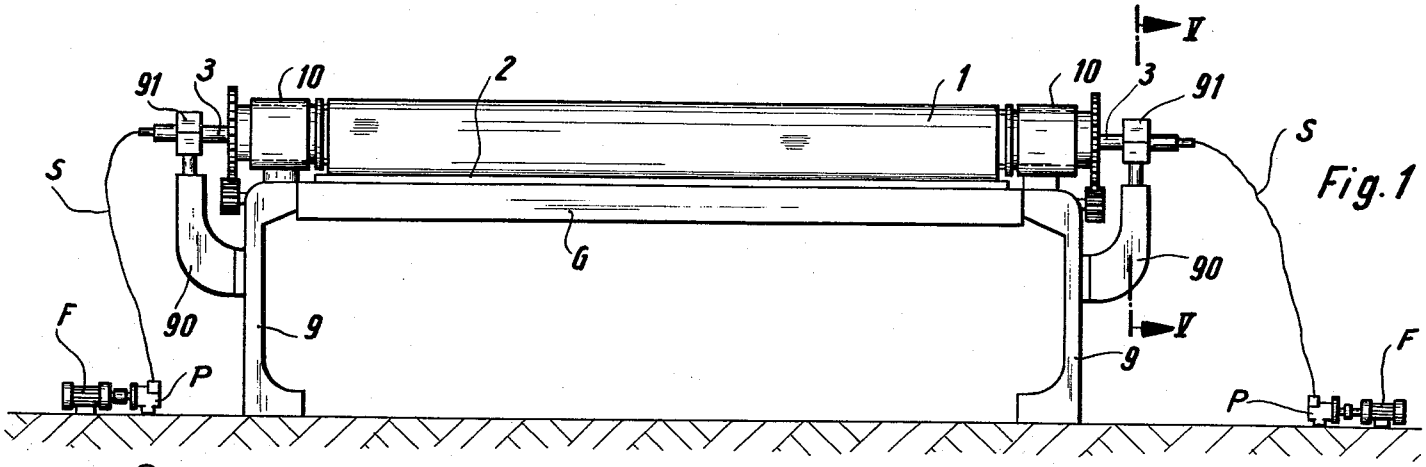
FIG. 1 is a schematic elevational view of a screen printing machine which embodies the invention.

Referring first to FIGS. 1 to 4, there is shown a portion of a screen printing machine which comprises a rotary horizontal cylindrical screen or stencil 1. The lowermost portion of the external surface of the stencil 1 contacts a web 2 of fabric or other material to be printed. The fabric is moved towards the right in FIGS. 4 and 4*a* and is preferably advanced together with a suitable back cloth, not shown, which travels above a stationary counter-pressure beam G of the type disclosed, for example, in my copending application Ser. No. 488,719, filed July 15, 1974. The cylindrical stencil 1 can be replaced by an endless band-like stencil which is trained over at least three rolls at least one of which is driven and at least one of which constitutes a tensioning means for the band.

The stationary support means for the pivotable holer 7 of a blade-like elastically deformable squeegee 8 comprises a horizontal fluid-supplying pipe or header 3 and a carrier 4 which is welded or otherwise rigidly secured to the pipe 3 in the interior of the stencil 1. The pipe 3 can supply into the stencil 1 a highly viscous (pasty) or readily flowable liquid substance, e.g., an adhesive or a coloring agent. As shown in FIG. 4, the top porion of the pipe 3 has at least one port 3*a* which discharges the liquid against the internal surface of a baffle-like deflector 3*b*.

The carrier 4 is located at a level below the tube 3 and includes a substantially U-shaped wall or portion 42 having a concave underside serving as an abutment for the adjacent portion of an elongated tubular cushion or biasing means 5 which is filled with a compressed gas (e.g., air) and serves to urge the holder 7 downwardly, as viewed in FIG. 4, whereby to edge portion 8A of the blade-like squeegee 8 bears against the internal surface of the stencil 1 with a force which is proportional to the pressure of gaseous fluid in the cushion 5. The means for holding the cushion 5 against movement out of the socket which is defined by the portion 42 of the carrier 4 includes two shoulders 40 which may constitute horizontal ledges forming integral or separable parts of the carrier.

The carrier 4 further comprises several (e.g., two) laterally extending brackets or fins 41 which support a pintle 6 extending in parallelism with the axis of the stencil 1 and with the edge portion 8A of the squeegee 8. The pintle 6 may constitute a one-piece shaft or it may consist of two or more discrete coaxial sections each of which is preferably mounted in at least two brackets 41. It will be noted that the pintle 6 is located ahead of the squeegee 8, as considered in the direction of rotation of the stencil 1 (see the arrow D in FIG. 4).

The holder 7 for the squeegee 8 is pivotable about or with the pintle 6 and comprises a first portion 71 which is directly mounted on the pintle 6, a second portion 72 which supports the squeegee 8, and screws, bolts or analogous fasteners 73 for rigidly but separably connecting the portion 72 to the portion 71. FIG. 4 shows that the portions 71, 72 have complementary (mating) parts 71A, 72A which are in face-to-face abutment with each other and that the parts 71A, 72A have aligned external surfaces 71B, 72B which merge into each other to insure a smooth transition from the portion 71 into the portion 72 or vice versa. If desired, the one-piece portion 71 of the holder 7 can be replaced by two or more discrete elements which are spaced apart from each other, as considered in the axial direction of the pintle 6, and each of which is separably attached to the portion 72. For example, the portion 71 of the holder 7 may comprise a discrete element for each bracket 41 of the carrier 4. The portion 72 of the holder 7 may consist of a suitable synthetic plastic material.

Those parts of the portion 72 of the holder 7 which are remote from the pintle 6 carry one or more eyelets 74 for the lower end portions of vertical helical springs 75 which serve to bias the holder and the squeegee 8 counterclockwise, as viewed in FIG. 4, i.e., to urge the edge portion 8A away from the internal surface of the stencil 1. The bias of the springs 75 is preferably selected in such a way that they counteract the combined weight of the holder 7 and squeegee 8 so that the force with which the edge portion 8A bears against the stencil 1 is determined exclusively or practically exclusively by the pressure of gaseous fluid which is confined in the cushion 5. The eyelets 74 may be formed with externally threaded shanks which extend into tapped bores of the portion 72. The upper end portions of the spring 75 are attached to retainers 3*d* on the pipe 3; however, it is also possible to provide such retainers on the upper portion of the carrier 4.

The cross section of the squeegee 8 is T-shaped and the head 80 of this squeegee extends into a mating groove 76 provided in the underside of the holder portion 72. However, it is equally within the purview of the invention to employ a rod-like cylindrical squeegee 8*a* of the type shown in FIG. 4*a;* the major portion of the squeegee 8*a* is received in a complementary elongated socket 76*a* provided in a modified holder portion 72*a*.

Referring again to FIGS. 1 to 4, the portion 72 of the holder 7 comprises an upwardly projecting elongated extension or rail 77 which is bounded by a rounded (substantially semi-cylindrical) surface and bears against the underside of the deformable cushion 5 so as to impart to the cushion a kidney-shaped cross-sectional outline. The axis of the pintle 6 and the axes of the shanks of eyelets 74 are preferably located in a common horizontal plane which extends substantially midway between the cushion 5 and the squeegee 8. Also, the extension 77 and the squeegee 8 preferably have a common vertical symmetry plane which includes the axis of the tube 3 and is normal to the plane of the web 2 in the region where the web is contacted by the external surface of the stencil 1. Since the squeegee 8 is located substantially or exactly midway between the pintle 6 and the springs 75, its downwardly extending part can be located in a vertical plane when the edge portion 8A is not deflected by the internal surface of the stencil 1; this insures that the extend of deflection of the edge portion 8A from such vertical plane can be regulated by the simple expedient of changing the pressure of fluid in the cushion 5. Such mounting of the holder 7 further insures that the squeegee 8 is not likely to vibrate, oscillate or perform other stray movements when the screen printing machine is in use. The rounded upper surface of the extension 77 reduces the likelihood of damage to the cushion 5 and enables the latter to lie flush against the internal surface of the U-shaped portion 42 of the carrier 4.

If the attendants desire to clean the squeegee 8, the lower end portions of the springs 75 are detached from the respective eyelets 74, the pipe 3 is moved upwardly together with the support 4 (arrow A in FIG. 4) to raise the pintle 6, and the holder 7 is pivoted clockwise (arrow B in FIG. 4) so that the edge portion 8A of the squeegee faces upwardly and the entire squeegee (save for the head 80) is readily accessible.)

If the squeegee 8 is to be replaced with a fresh or differently configurated squeegee, the fasteners 73 are loosened or removed so that the portion 72 of the holder 7 becomes separated from the portion 71, and the parts 72, 8 are then withdrawn through the one or the other end of the stencil 1. It is also possible to remove the squeegee 8 by simply pushing it lengthwise of the portion 72 while the latter remains attached to the portion 71, and to thereupon introduce the head 80 of a fresh squeegee into the socket 76 in a similar way.

If the machine comprises two or more stencils, each stencil, a single stencil, or selected stencils may receive a squeegee which is mounted in a manner as shown for the squeegee 8 or 8*a* of FIGS. 1–4 or FIG. 4*a*.

An important advantage of a pintle which is located ahead of the locus where the squeegee engages the internal surface of the stencil, as considered in the direction of movement of the stencil, is that the bearings (brackets 41) for the pintle can take up substantial stresses and that such stresses can be distributed along the full length of the stencil, depending on the number and distribution of the brackets 41. Consequently, and due to the provision of biasing means 75, the force with which the squeegee is urged against the internal surface of the stencil can be reduced to a minimum so that the machine can employ squeegees which consist of thin steel sheet stock, of an elastomeric (rubber-like) material, and/or a combination of both. The biasing means 75 which counteracts the weight of the holder 7 or 7*a* and squeegee 8 or 8*a* insures that the friction between the internal surface of the stencil and the squeegee can be reduced to a very low value so that the locus of contact between the stencil and the squeegee changes very little or not at all and that the vibration of squeegee is negligible. The bias of the springs 75 can be selected with a view to counteract only the combined weight of the squeegee and holder 7 or 7*a;* thus, when the pressure of fluid in the cushion 5 is reduced, the squeegee can be lifted off or maintained in negligible frictional engagement with the stencil.

Figures 2, 3:
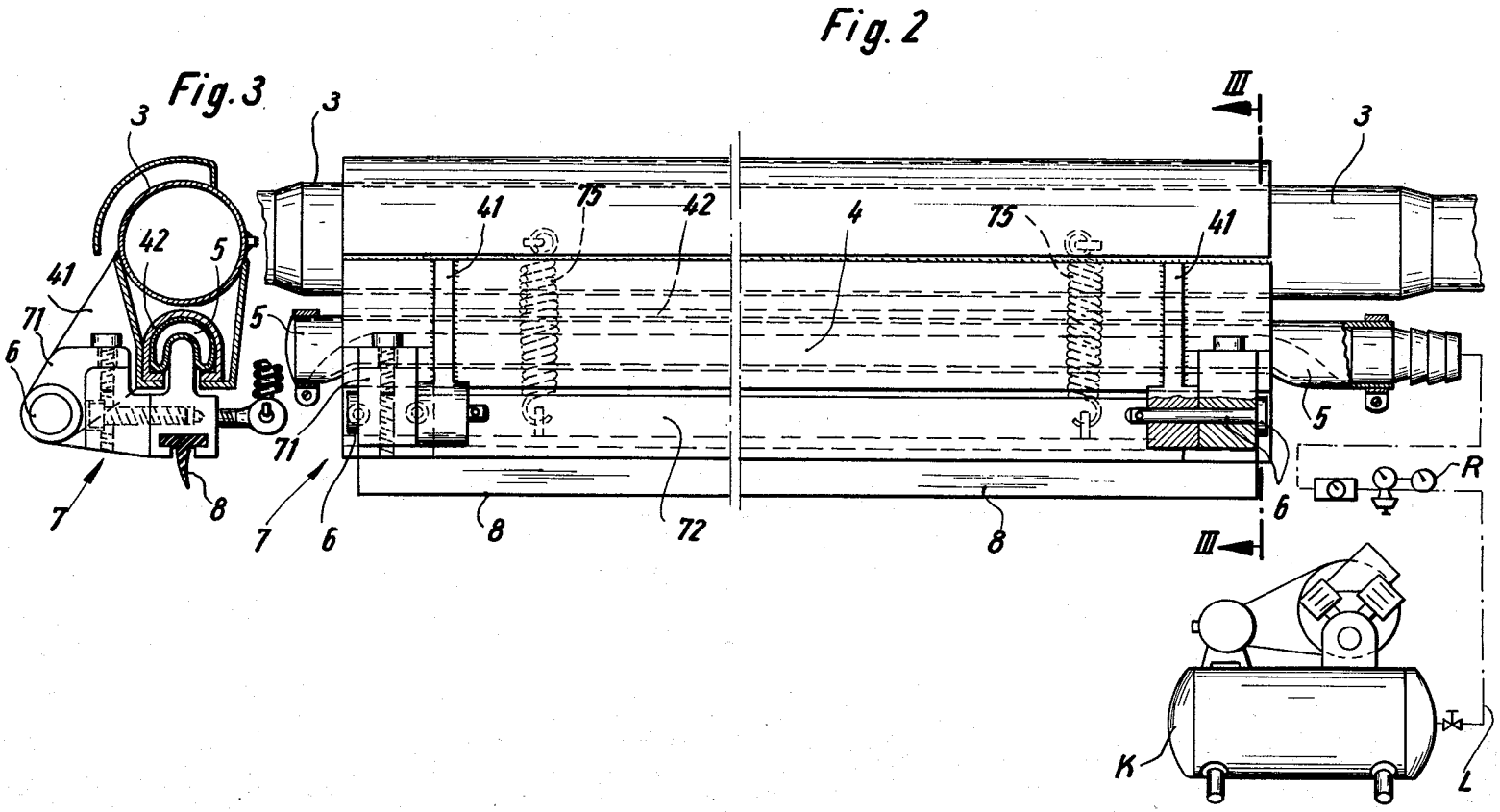
FIG. 2 is an enlarged longitudinal vertical sectional view of the structure shown in the central portion of FIG. 1.
FIG. 3 is a transverse vertical sectional view as seen in the direction of arrows from the line III—III of FIG. 2.

FIg. 2 further shows a comressor K which can supply to the cushion 5 compressed air through a conduit L. The pressure of fluid in the cushion 5 can be regulated by a control system R including a throttle valve, a shut-off valve and/or others, and one or more gauges.

FIG. 1 shows two pumps P, driven by motors F, which supply liquid to the respective ends of the pipe 3 by way of conduits S.

Figure 6:
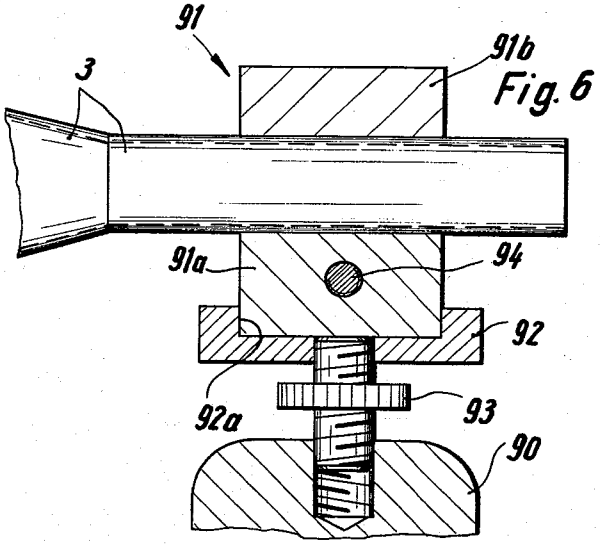
FIg. 6 is a sectional view as seen in the direction of arrows from the line VI—VI of FIG. 5.
Figure 5:
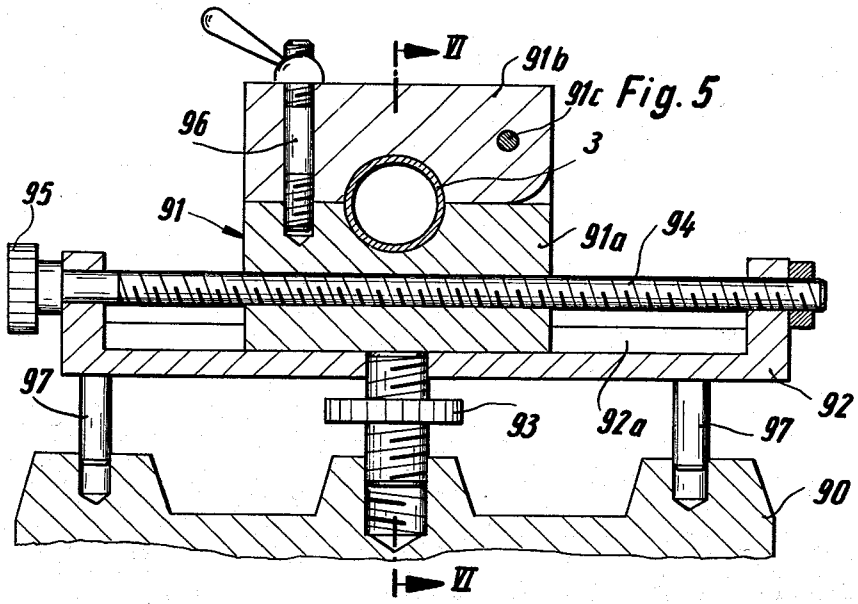
FIG. 5 is an enlarged vertical sectional view as seen in the direction of arrows from the line V—V of FIG. 1.

The end portions of the pipe 3 extend beyond the bearings or heads 10 for the stencil 1 and are mounted in bearing members 91 one of which is shown in FIGS. 5 and 6. Each bearing member 91 has a lower portion or jaw 91*a* and an upper portion of jaw 91*b* which is pivotable at 91*c*. A threaded locking member 96 can be used to hold the portion 91*b* against pivotal movement on the pin 91*c*. The lower portion 91*a* is provided with a tapped through bore receiving a portion of a feed screw 94 having a handgrip portion 95. By rotating the feed screw 94, an attendant can move the bearing member 91 transversely of the stencil 1 in ways 92*a* provided in a base 92. The base 92 is movable up and down with respect to an arm 90 of the machine frame 9 by rotating a vertical screw 93 which meshes with the arm 90 and extends into a socket of the base 92 below the bearing member 91. The reference characters 97 denote guide pins which are secured to the base 92 and extend into vertical holes of the arm 90. The screw 93 allows for an accurate adjustment of the level of the corresponding end portion of the pipe 3, carrier 4, holder 7 and squeegee 8.

Figure 7:
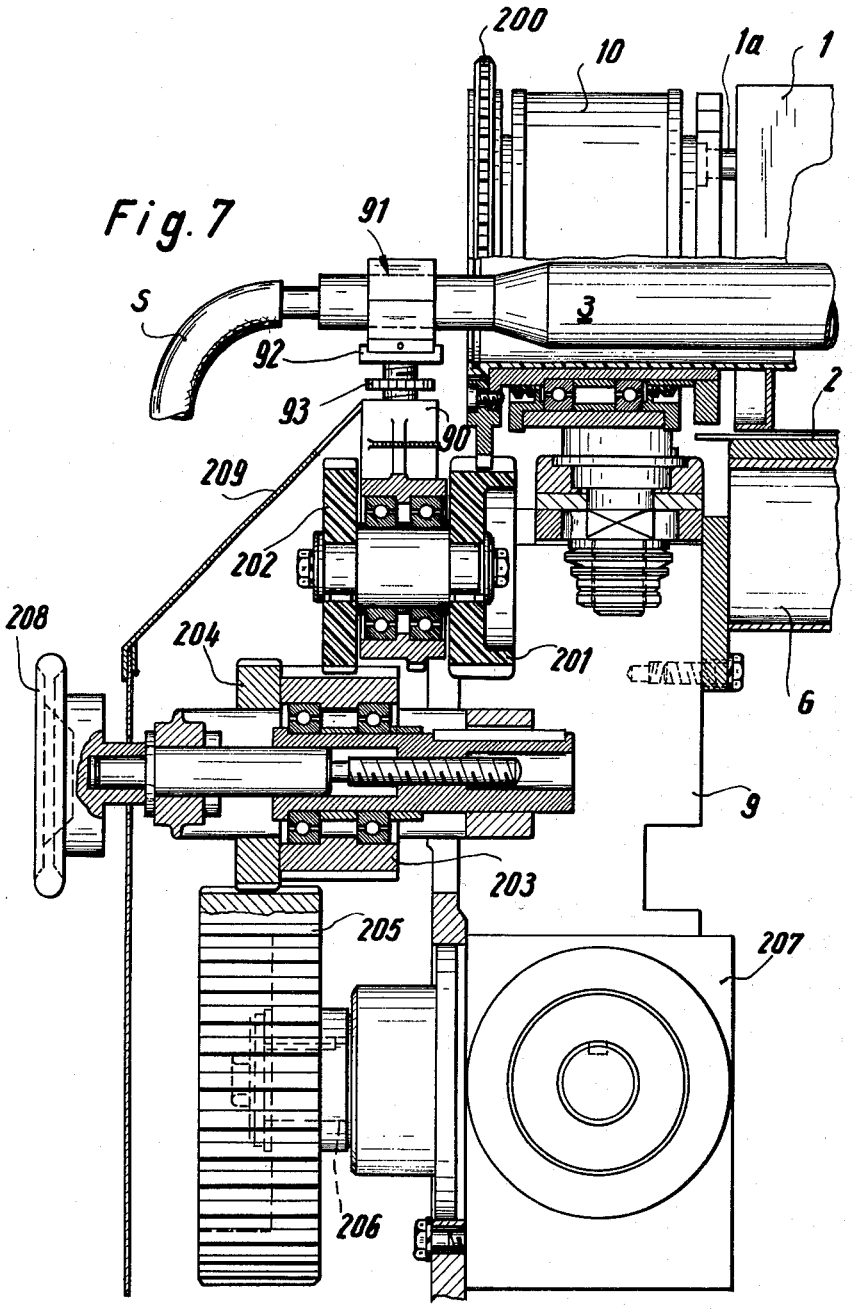
FIG. 7 is an enlarged partly elevational and partly vertical sectional view of the drive means for the stencil.

FIG. 7 illustrates the construction of drive means for rotating the stencil 1. The illustrated end portion of the stencil 1 is connected with an annular holder 1*a* which is rotatable in the respective head 10 and carries a gear 200 forming part of a gear train which further includes the gears 201, 202, 203, 204 and 205. The gear 205 is mounted on the output shaft 206 of a prime mover 207, e.g., a hydraulically operated motor. A similar train of gears can be provided to drive the other end of the stencil 1. The hand wheel 208 of FIG. 7 can be turned to move the hub on which gears 203, 204 are mounted, in axial direction so as to shift the gear 203 into and out of mesh with the gear 202 or the gear 204 into or out of mesh with the gear 205. A shield 209 is provided to confine the gear train so as to reduce the likelihood of injury to attendants.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. In a screen printing machine, the combination of an elongated tubular liquid-permeable stencil having endless internal and external surfaces; means for moving said stencil in a predetermined direction relative to a moving web of material to be printed so that successive increments of said external surface contact successive increments of the web; stationary support means having portions located in the interior of said stencil for supporting a holder; a squeegee adjacent to and in contact with said internal surface along a line of contact; a holder for holding said squeegee and being pivotably supported on said portions of said support means so that said holder can turn about a pivot axis which extends transverse to the direction of movement of said stencil and is located ahead of said squeegee, as considered in said direction of movement; first biasing means for biasing said holder, said first biasing means being located above said holder upwardly of the line of contact between said squeegee and said internal surface, so as to urge said squeegee in vertical direction against said internal surface; and second biasing means engaging said holder and acting upon the same in opposition to said first-mentioned biasing means.

2. The combination of claim 1, wherein said support means comprises a plurality of brackets and a pintle mounted in said brackets.

3. The combination of claim 1, wherein said holder comprises a first portion pivotable about said axis, a second portion supporting said squeegee, and fastener means securing said second portion to said first portion.

4. The combination of claim 1, wherein said support means comprises a U-shaped portion and said first biasing means includes a gas-filled cushion received in said U-shaped portion.

5. The combination of claim 1, wherein said first biasing means comprises a deformable hollow cushion interposed between said support means and said holder and means for maintaining a supply of pressurized gaseous fluid in said cushion.

6. The combination of claim 5, wherein said squeegee comprises a doctor blade having an elongated edge portion engaging said internal surface, said axis being located in a horizontal plane which extends substantially midway between said edge portion and said cushion.

7. The combination of claim 1, wherein said second biasing means urges said holder in a direction to disengage said squeegee from said internal surface against the opposition of said first biasing means and with a force which compensates for the combined weight of said holder and said squeegee.

8. The combination of claim 7, wherein said pivot axis is substantially horizontal and said second biasing means comprises at least one spring connected to said holder at a point which is spaced from said axis.

9. The combination of claim 1, wherein said holder comprises a plurality of discrete portions and fastener means separably securing said portions to each other.

10. The combination of claim 9, wherein said portions of said holder have complementary parts which abut against each other and said parts have aligned external surfaces.

11. The combination of claim 1, wherein said support means includes a liquid supplying tube and a carrier secured to said tube, said holder being pivoted to said carrier.

12. The combination of claim 11, wherein said carrier has a concave surface and said first biasing means comprises a gas-filled cushion abutting against said concave surface.

13. The combination of claim 1, wherein said pivot axis is substantially horizontal and said squeegee is located at a level below said axis, said first biasing means comprising a gas-filled cushion abutting against said support means at a level above said axis and said holder having an upwardly projecting extension bearing against said cushion.

14. The combination of claim 13, wherein said support means has a concave recess for said cushion and said extension has a rounded external surface bearing against said cushion in said recess so as to impart to the cushion a substantially kidney-shaped profile.

15. The combination of claim 14, wherein said squeegee comprises a deformable blade having an edge portion engaging said internal surface, said extension and said blade having a common substantially vertical symmetry plane.

16. In a screen printing machine, the combination of an elongated tubular liquid-permeable stencil having endless internal and external surfaces; means for moving said stencil in a predetermined direction relative to a moving web of material to be printed so that successive increments of said external surface contact successive increments of the web; a holder; stationary support means having portions located in the interior of said stencil for supporting said holder; a squeegee mounted in said holder adjacent to and in contact with said internal surface along a line of contact; means for pivotably coupling said holder to said portions of said support means so that said holder can turn about a pivot axis which extends transverse to the direction of movement of said stencil and is located ahead of said squeegee, as considered in said direction of movement; first biasing means for biasing said holder, said first biasing means being located above said holder upwardly of the line of contact between said squeegee and said internal surface, so as to urge said squeegee in vertical direction against said internal surface; and releasable second biasing means engaging said holder and acting upon the same in opposition to said first-mentioned biasing means, said second biasing means being disengageable from said holder to permit pivoting of the same about said axis to a position in which said squeegee is freely accessible to an operator.

17. In a screen printing machine, the combination of an elongated tubular liquid-permeable stencil having endless internal and external surfaces; means for moving said stencil in a predetermined direction relative to a moving web of material to be printed so that successive increments of said external surface contact successive increments of the web; a holder; stationary support means having portions located in the interior of said stencil for supporting said holder turnable about a substantially horizontal axis; a squeegee mounted in said holder adjacent to and in contact with said internal surface along a line of contact; means for pivotably coupling said holder to said portions of said support means so that said holer can turn about a pivot axis which extends transverse to the direction of movement of said stencil and is located ahead of said squeegee, as considered in said direction of movement, said holder comprising a first portion which is pivotable about said axis, a second portion mounting said squeegee, and fastener means rigidly securing said second portion to said first portion; first biasing means for biasing said holder in a direction to move said squeegee away from said internal surface, comprising at least one eyelet provided on said second portion and a spring having a first portion affixed to said eyelet and a second portion affixed to said support means; and second biasing means located above said holder upwardly of the line of contact between said squeegee and said internal surface, for urging said squeegee in vertical direction against said internal surface.

18. The combination of claim 17, wherein said spring is a helical spring having a substantially vertical axis.

19. The combination of claim 18, wherein said eyelet is located at the level of said first-mentioned axis.

* * * * *